US012582219B2

(12) United States Patent
Ahl et al.

(10) Patent No.: US 12,582,219 B2
(45) Date of Patent: Mar. 24, 2026

(54) MOLLE AND SLIDER COMPATIBLE CLIP

(71) Applicant: CIRK-L AB, Malmö (SE)

(72) Inventors: Christian Ahl, Malmö (SE); Andreas Friberg, Ystad (SE); Filip Larsson, Ystad (SE)

(73) Assignee: CIRK-L AB, Malmö (SE)

( * ) Notice: Subject to any disclaimer, the term of this patent is extended or adjusted under 35 U.S.C. 154(b) by 319 days.

(21) Appl. No.: 18/562,574

(22) PCT Filed: May 20, 2022

(86) PCT No.: PCT/EP2022/063688
§ 371 (c)(1),
(2) Date: Nov. 20, 2023

(87) PCT Pub. No.: WO2022/243499
PCT Pub. Date: Nov. 24, 2022

(65) Prior Publication Data

US 2024/0268544 A1 Aug. 15, 2024

(30) Foreign Application Priority Data

May 20, 2021 (EP) ..... 21175001

(51) Int. Cl.
*A45F 5/02* (2006.01)

(52) U.S. Cl.
CPC ..... *A45F 5/02* (2013.01); *A45F 2005/023* (2013.01)

(58) Field of Classification Search
CPC ..... A45F 5/021; A45F 2005/026; A45F 5/02; A45F 2003/001; A45F 2005/023; Y10T 24/1394; Y10T 24/13; Y10T 24/4453; Y10T 24/4016; A44B 11/12; A45C 2013/306
USPC ..... 224/667; 24/13, 517, 543, 545, 3.11, 24/3.12, 170
See application file for complete search history.

(56) References Cited

U.S. PATENT DOCUMENTS 2,823,434 A * 2/1958 Buren, Jr. ..... F16B 45/04 24/3.1
5,341,975 A 8/1994 Marinesco
6,315,182 B1 11/2001 Chen
(Continued)

FOREIGN PATENT DOCUMENTS

CN 104490071 A 4/2015
JP 2001137033 A 5/2001

*Primary Examiner* — Adam J Waggenspack
(74) *Attorney, Agent, or Firm* — Dinsmore & Shohl LLP

(57) ABSTRACT

A MOLLE and slider attachment compatible clip includes a main body with a back side, an inverted V- or U-shaped front side, a top and an open bottom side. The clip receives a MOLLE strap/slider attachment element from the open bottom side. A locking element, in the main body, includes a bottom hook for securing the MOLLE strap/slider attachment element. A pull element is connected to the locking element through a top opening of the top side. A lock control mechanism unlocked the MOLLE strap/slider attachment element from the locked to open position by moving the bottom hook towards the back side when the pull element is pulled upwards. An assembly includes a MOLLE/slider attachment compatible clip and a slider attachment element with a locking flange that can be locked/unlocked in the clip and a clutch to engage/hold a garment connection element.

15 Claims, 10 Drawing Sheets

(56) References Cited

U.S. PATENT DOCUMENTS

| | | | | |
|---|---|---|---|---|
| 6,438,808 | B1 * | 8/2002 | Kung | A45F 5/02 24/3.12 |
| 6,510,592 | B1 | 1/2003 | Hamilton | |
| 8,713,764 | B1 * | 5/2014 | Rittenhouse | A45F 3/14 24/3.12 |
| 9,451,821 | B1 | 9/2016 | Estigoy | |
| 9,938,995 | B2 | 4/2018 | Miltner et al. | |
| 10,299,574 | B1 * | 5/2019 | Chen | A45F 5/02 |
| 2003/0106917 | A1 | 6/2003 | Shetler et al. | |
| 2010/0294816 | A1 | 11/2010 | Sentell | |
| 2013/0047386 | A1 | 2/2013 | Barfoot et al. | |
| 2013/0161363 | A1 | 6/2013 | Johnson | |
| 2015/0211554 | A1 * | 7/2015 | Wu | F16B 2/10 24/500 |
| 2016/0095422 | A1 | 4/2016 | Ralph | |
| 2018/0199698 | A1 | 7/2018 | Fiorello | |

* cited by examiner

MOLLE AND SLIDER COMPATIBLE CLIP

CROSS-REFERENCE TO RELATED APPLICATIONS

This application is the U.S. National Stage of PCT/EP2022/063688 filed on May 20, 2022, which claims priority to European Patent Application 21175001.3 filed on May 20, 2021, the entire content of both are incorporated herein by reference in their entirety.

FIELD OF THE INVENTION

The present disclosure relates to a MOLLE and slider compatible clip.

BACKGROUND OF THE INVENTION

MOLLE is an acronym for Modular Light-Weight Load-Carrying Equipment. It is a well-known and widely used standard for attachments of garments, pieces of garments, tools, and tools pockets. A typical MOLLE attachment is based on a MOLLE strap. In widely known configurations a set of garments is provided with a MOLLE strap. Another piece or element, such as a tool holder, is then attached to the MOLLE strap using an attachment means, which could be made of plastic, metal or other material and which secures the piece or element to the garment.

The MOLLE standard is widely used in the military sector, where armed forces utilize clothes, back-packs and other garments or other load-bearing equipment provided with MOLLE straps. The MOLLE standard is also used within civil applications, for example on garments, back-packs and other load-bearing equipment for fishing, hunting, mountain-walking etc.

Furthermore, the MOLLE standard is used also for garments and load-bearing equipment for workers, for example in the construction sector, where workers and craftsmen need to have their tool pockets attached to their garments, or where tools or tool pockets need to be attached to larger tool boxes.

The currently existing solutions, while providing a form of attachment between, for example a piece of garment provided with a MOLLE strap and a tool holder, are characterized by several disadvantages related in particular to the ease of release for a user who is, for instance, engaged in work-related activities in the field, where the ease of attachment and detachment is important for operating in security in cases where, for example, the user is a worker located on a ladder or on the roof of a building and needs to extract and re-attach the tool pocket from the garment easily and conveniently without, for example, risk for dropping the tool pocket or for falling off the ladder.

Another issue with MOLLE clips is that they are fixed to a specific place on a garment, which may be inconvenient for, for example, craftsmen or even officers such as police officers or firemen, who may prefer to move tools by moving the means to which the tools are fastened.

There is thus a need for an improved MOLLE clip.

SUMMARY OF THE INVENTION

In the present disclosure a clip is described, which is compatible with both a MOLLE strap and a slider attachment, which can be further attached to, for example, a rail of a belt. Preferably, the clip can receive a locking flange of the slider attachment.

Craftsmen in different technical fields, for instance carpenters, often use work wear and find it advantageous to have tool pockets attached to their garment in order to be able carry the tools directly to the workplace, that possibly being a ladder or the roof of a building.

Moreover, for craftsmen it is advantageous and often critical to be able not only to have tool pockets attached to their garments, but also to have these pockets easily releasable and re-attachable. Specifically it is an advantage if the tool pockets are attachable and releasable with one gesture, and the operations can be effectively and easily performable with one hand.

In addition effective and easy to use attachments are also advantageous when connecting tool boxes to each other, for example in a scenario where a larger tool box, provided for example by one or several MOLLE straps, receives by attachment several other small tool boxes or tool pockets. The effectiveness and easy to use of the attachments is also of great advantage for the craftsmen that need to transport the tool boxes and subsequently detach them or reattach them for their work.

MOLLE straps are often used to provide these type of attachments but common means for attachment to MOLLE straps suffer from being often not so effective and not so easy to use, as they often cannot provide attachment and detachment with one gesture, preferably with one hand only and in a secure and fully functional manner.

For instance many solutions provide different types of MOLLE-compatible clips which are cumbersome when having to be detached or that require the use of two fingers to press an unlocking mechanism or where the unlocking mechanism is hidden under a pouch or where the unlocking and releasing of the clip requires two or more separate gestures. The clip is often attached to a first element, such as a pouch or a tool box or a tool pouch or tool pocket or an accessory or smaller unit, that is attached to a second piece of garment by attachment provided by the clip and a MOLLE-strap. Due to the size of the pouch the clip is often hidden by the pouch itself and often difficult to reach for the hands of the user. For this reason, in fact it is beneficial that, whilst a locking/unlocking mechanism can provide unlocking of a clip with a gesture, with the same gesture a complete release or detachment or separation of the clip from the strap is achieved. It may also be beneficial that the simultaneous unlocking and releasing/detaching of the clip can happen using an element which is easily reachable and that can provide effective and easy operation, such as a pull-strap.

According to a first embodiment, a MOLLE and slider attachment compatible clip is disclosed, comprising:

a. a main body comprising a back side, an inverted V-shaped or inverted U-shaped front side, a top side and an open bottom side, wherein the clip is configured to receive a MOLLE strap or a slider attachment element from the open bottom side of the main body;

b. a locking element arranged in the main body, the locking element comprising a bottom hook for securing the MOLLE strap or a slider attachment element in a locked position in the main body;

c. a pull element connected to the locking element through a top opening of the top side of the main body;

a lock control mechanism configured to unlock the MOLLE strap or the slider attachment element from the locked position to an open position by moving the bottom hook towards the back side when the pull element is pulled upwards. Such a clip is not only compatible with both a MOLLE and slider attachment, but also easily unlocked and released using a simple gesture, such as a pulling gesture, and such as a one-handed gesture. Moreover the, clip may easily be locked and attached with a second simple gesture, such as a pushing gesture, such as a one-handed gesture. In particular, the MOLLE and slider attachment compatible clip may further be configured to unlock and detach the MOLLE strap or the slider attachment element from the clip with one gesture of pulling up the pull element. In other words, by pulling, for example, a pull strap upwards, it may be possible not only to unlock the clip but also to detach the clip from the strap or slider attachment element. This is a convenient solution if, for example, the slider attachment is attached to a rail of a belt. In particular the presently disclosed MOLLE and slider attachment compatible clip, in contrast to the existing solutions, provides a solution which is both secure and easy to use. Conventional MOLLE clips are typically either easy to attach but do not have a locking mechanism, or have a locking mechanism, which, however, require two hands or more than one gesture to lock.

The clip of the present disclosure may therefore attach to a MOLLE strap, making it compatible with any piece of garment or equipment provided with a MOLLE-strap.

The clip of the present disclosure may therefore also attach to a slider attachment element of a slider, whenever a slider is present on the pocket or on a first element or equipment, such as a tool pouch or tool pocket or tool box or accessory or smaller unit.

In one embodiment of the present disclosure, the MOLLE and slider attachment compatible clip is such that the lock control mechanism is configured to move the locking element from the locked position to the open position when the MOLLE strap or a slider attachment element is received from the open bottom side of the main body.

The lock control mechanism of the MOLLE and slider attachment compatible clip may be configured to move the locking element from the locked position to the open position by pushing the bottom hook towards the back side when the MOLLE strap or a slider attachment element is received from the open bottom side of the main body.

The lock control mechanism may be further configured to move the locking element from the locked position to the open position by pushing the bottom hook towards the back side when the MOLLE strap or a slider attachment element is received from the open bottom side of the main body.

The present disclosure further relates to a MOLLE clip comprising:

a. a main body comprising a back side, a front side, a top side and an open bottom side, wherein the clip is configured to receive a MOLLE strap from the open bottom side of the main body;
b. a locking element arranged in the main body, the locking element comprising a bottom hook for securing the MOLLE strap in a locked position in the main body;
c. a pull element connected to the locking element through a top opening of the top side of the main body; and
d. a lock control mechanism configured to unlock the MOLLE strap from the locked position to an open position by moving the bottom hook towards the back side when the pull element is pulled upwards.

The present disclosure further relates to an assembly comprising:

a. a MOLLE and slider attachment compatible clip,
b. a slider attachment element comprising a locking flange that can be locked and unlocked in the MOLLE and slider attachment compatible clip and a clutch configured to engage and hold a connection element of a garment.

BRIEF DESCRIPTION OF THE DRAWINGS

Embodiments of the presently disclosed invention are presented with help of the following figures. The drawings are exemplary and are intended to illustrate some of the features of the presently disclosed clip, and are not to be construed as limiting to the presently disclosed invention.

DETAILED DESCRIPTION OF THE INVENTION

Figures 1A, 1B, 1C, 1D:
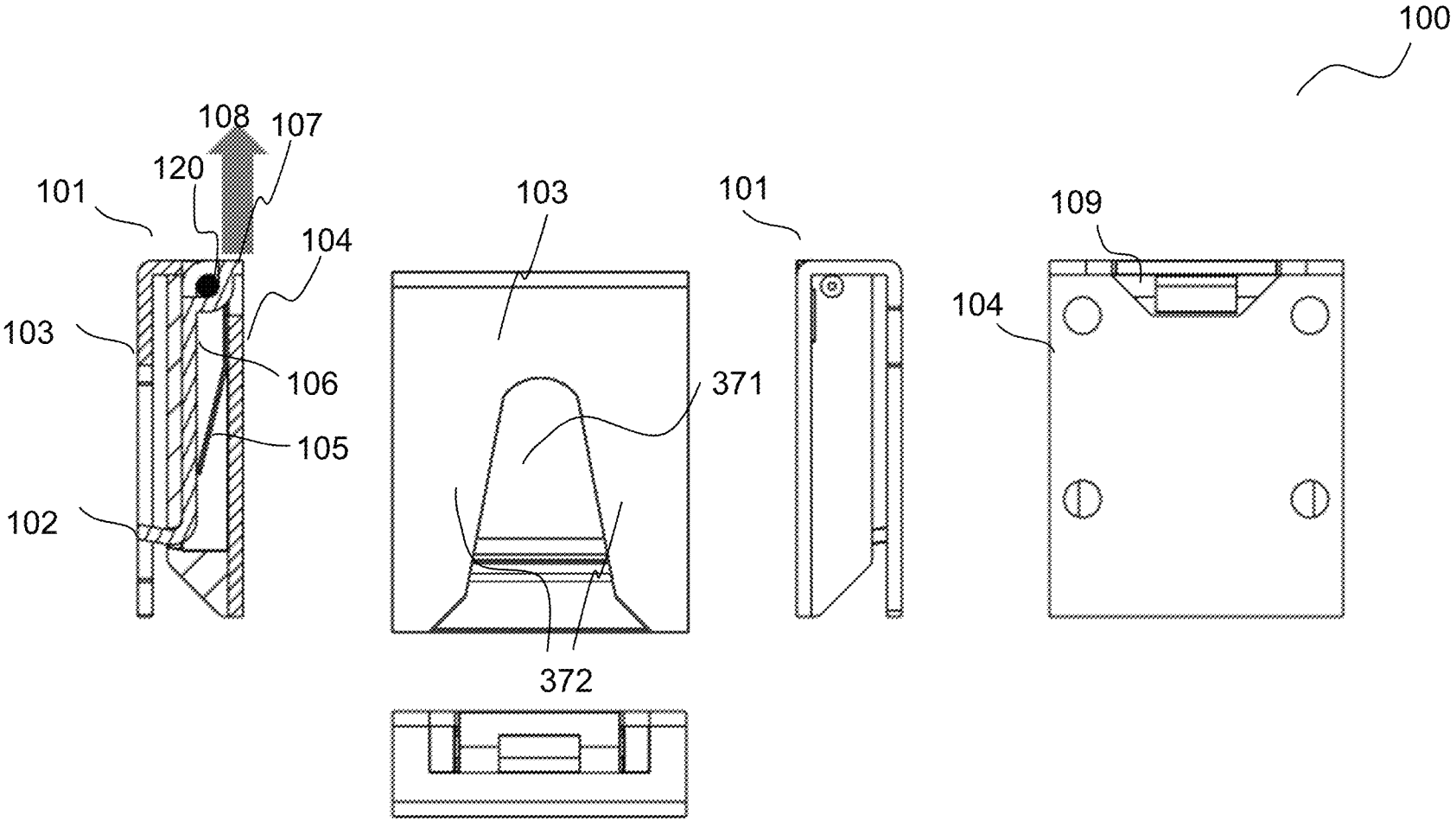
FIG. 1A-1D show an embodiment of the presently disclosed MOLLE and slider attachment compatible clip.

The present disclosure relates to a MOLLE and slider attachment compatible clip comprising: a main body comprising a back side and a front side. Preferably the front side is inverted V-shaped or inverted U-shaped front side. The clip may further comprise a top side and an open bottom side, wherein the clip is configured to receive a MOLLE strap or a slider attachment element from the open bottom side of the main body. The clip may further comprise a locking element arranged in the main body. Preferably, the locking element comprises a bottom hook for securing the MOLLE strap or a slider attachment element in a locked position in the main body. The clip may further comprise a pull element connected to the locking element through a top opening of the top side of the main body. The clip may further comprise a lock control mechanism configured to unlock the MOLLE strap or the slider attachment element from the locked position to an open position by moving the bottom hook towards the back side when the pull element is pulled upwards.

In one configuration of the presently disclosed MOLLE and slider attachment compatible clip, the back side of the clip may be attached to a first element, such as a tool pouch or tool pocket or tool box or accessory or smaller unit.

In one configuration of the presently disclosed MOLLE and slider attachment compatible clip, the MOLLE strap may be attached to a second element, such as a second piece of garment or a second tool box.

In one embodiment, the presently disclosed clip is used as an attachment to a MOLLE strap. The MOLLE standard is widely used. The dimensions of a MOLLE strap would therefore be known to a person skilled in the art. The presently disclosed clip may be attached and locked to the MOLLE strap by a simple gesture like pushing and may be unlocked and released from the strap by a simple gesture, such as pulling. The effectiveness of the attachment and detachment gestures may favour ease of use, safety and security when the clip is used to attach a second piece of garment provided with a MOLLE strap, such as trousers or a jacket, to a first element, provided with the clip, such as a tool pouch or pocket or box or accessory or smaller unit.

In a further embodiment, the presently disclosed clip is attached to a first element, such as a tool pouch or pocket or box or accessory or smaller unit, and is used as an attachment to a slider attachment, itself attached to a second piece of garment, such as trousers or a jacket, and to a second piece of garment. The slider may be located in rails of the second piece of garment, such as rails going around the waistline of trousers or a jacket or a belt, and therefore, when the clip is attached to the slider, the first element may be able to be positioned in different locations, such as a left side or a right side of a worker or an officer wearing the second piece of garment.

The presently disclosed clip may be attached and locked to the slider by a simple gesture like pushing and may be unlocked and released from the slider by a simple gesture as pulling. The effectiveness of the attachment and detachment gestures may favour ease of use, safety and security for a craftsman, or an officer, such as a police officer or a fireman or military officer, wearing the second piece of garment and wanting to have attached to it a first element, such as a tool pouch or tool pocket or tool box or accessory or smaller unit.

The use of the presently disclosed clip both in case of it being attached to a MOLLE strap or a slider attachment element is targeted, but not limited, to workers or officers wanting to have a first element, such as a tool pouch or tool pocket or tool box or accessory or smaller unit, attached to a second piece of garment, such as trousers or a jacket.

The use of the presently disclosed clip both in case of it being attached to a MOLLE strap or a slider attachment element is targeted, but not limited, to workers or officers wanting to attach a first element, such as a tool pouch or tool pocket or tool box or accessory or smaller unit, attached to a second tool box, such as a larger tool box.

The clip moreover favours modularity and reusability of tool pockets, tool pouches, tool boxes and similar, because they can be easily attached and detached from garments of the user, which may be a craftsman or an officer such as a policeman or a fireman, and attached or detached from tool boxes which may be used for transportation.

In combination with the slider attachment element, when the slider attachment element can itself be located on different positions of the second piece of garments, the clip provides a safe and secure attachment, which also may guarantee the possibility of moving the first element in different locations of the second piece of garment, such as for example around the waistline of a user.

In one embodiment of the present disclosure, the MOLLE strap may be between 3 and 4 cm wide, such as 3.8 cm wide and several straps may be located between 2 and 3 cm apart, such as 2.5 cm apart.

The lock control mechanism of the presently disclosed MOLLE and slider attachment compatible clip may be configured to move the locking element from the locked position to the open position when the MOLLE strap or a slider attachment element is received from the open bottom side of the main body. The lock control mechanism of the presently disclosed MOLLE and slider attachment compatible clip, may be configured to move the locking element from the locked position to the open position by pushing the bottom hook towards the back side when the MOLLE strap or a slider attachment element is received from the open bottom side of the main body. In this regard the bottom hook (102) may be bent upwards as shown in, for example, FIG. 1A. When the strap or slider attachment is introduced from the open bottom side, it will be directed towards the front side of the clip (103). When the strap or slider attachment is pushed further upwards, it will at the same time push the bottom hook towards the back side of the clip (104). The fact the hook inherently has an angle as shown in FIG. 1A allows for this mechanism.

The MOLLE and slider attachment compatible clip may be configured to unlock and detach the MOLLE strap or the slider attachment element from the clip with one gesture of pulling up the pull element. This feature of the presently disclosed clip is very advantageous when, for example, the clip is attached on a large pocket or pouch and has to be attached to a second garment, such as trousers. In this configuration, when attached to the MOLLE strap or the slider, the clip is hidden from the sight of the user wearing the trousers. The pull element of the clip may be a pull strap, or may be attached to a pull strap, substantially longer than the vertical height of the pocket or the pouch, and may be easily pulled, achieving this way the simultaneous unlock and release of the pouch. This is also illustrated in, inter alia, FIG. 1. When the pull element is pulled upwards it will first open the clip. Once the clip is open, the pulling movement will pull the clip away from the strap or slider attachment means, thereby detaching the MOLLE strap or the slider attachment element from the clip.

FIG. 1A-1D show a first embodiment of the present disclosure, which is provided as an example and is not limiting the scope of the present disclosure.

The lock control mechanism of the MOLLE and slider attachment compatible clip may comprise a peg (106) as shown in FIG. 1, wherein said peg may be attached to the bottom hook (102) and may be rotatable around a pivot point (120), allowing locking and unlocking of the control mechanism.

As shown in FIG. 1A-1D, the lock control mechanism of the presently disclosed MOLLE and slider attachment compatible clip may comprise a spring and/or a spring steel plate (105) configured to apply a lateral force that, in the locked position, secures the bottom hook to the locked position.

When the pull element is pulled upwards with a force greater than the force of the spring or the spring steel plate (105), the MOLLE strap or the slider attachment element is unlocked to an open position from the locked position.

In the first embodiment of the MOLLE and slider attachment compatible clip shown in FIG. 1, the pivot point (120) is located at the top side of the clip. Other pivot points may, however, be envisaged.

In the illustrated embodiment of the present disclosure shown in FIG. 1, the pull element is attached to the peg in position (107) of FIG. 1, and when pulled up in the direction of the arrow (108) generates a rotation of the peg (106), which causes the bottom hook (102) to be unlocked from the front side of the clip and to be moved towards the back side of the clip (104) allowing the unlock and detachment of the clip from the MOLLE strap or from the slider by simple continuation of the pull-up gesture.

In the first embodiment of the present disclosure shown in FIG. 1, the spring or the spring steel plate is located between the back side of the clip and the peg and, in a closed position, locks the hook within the inverted V-shaped or inverted U-shaped front side of the clip.

FIG. 1A-1D show a first embodiment of the presently disclosed MOLLE and slider attachment compatible clip (100) from different sides. In the first embodiment of the presently disclosed MOLLE and slider attachment compatible clip (100) the main body (101) may be inverted U-shaped. The inverted U-shape of the main body shall be construed as side view, or a cross-sectional side view, as the one in FIG. 1C. In this first embodiment the shape of the front side (103) may be inverted V or inverted U, seen from a front view. The bottom hook (102) is also shown in FIG. 1. The pull element is not shown in FIG. 1 but it is attached to the peg (106) in position (107) and is configured to pull the peg upwards for unlocking the clip, in the direction of the arrow (108). In the first embodiment, in a locked position, the bottom hook (102) is closed towards the front side. A push-up of the hook generated, for example, by the clip being pushed on a MOLLE strap or on a slider attachment, generates the opening of the bottom hook and its moving towards the back side of the clip, accommodating the insertion of a MOLLE strap or a clip. The inverted-V or inverted-U shape of the front side of the clip permits the accommodation of a slider within the arms of the inverted V or inverted U. In one embodiment of the presently disclosed MOLLE and slider attachment compatible clip, the inverted V-shaped or inverted U-shaped front side has an open bottom end. In one embodiment of the presently disclosed MOLLE and slider attachment compatible clip, the inverted V-shaped or inverted U-shaped front side is configured to receive a shaft of a slider from the open bottom end of the inverted V-shaped or inverted U-shaped front side. One embodiment of the presently disclosed MOLLE and slider attachment compatible clip comprises a front side having an open bottom end, the front side configured to receive a shaft of a slider from the open bottom end. The front side may have an notch. The notch may have any suitable shape and an open bottom end. Inverted V or inverted U, within the context of the present disclosure, shall not be interpreted strictly as a V or U, but as a shape having an open bottom side (end) through which an extension of a slider attachment can be introduced. This includes, for example, the shape shown in FIG. 1B. "Inverted V or inverted U" shall thus be interpreted as comprising any useful combination of an inverted U and an inverted V. The contours of the inverted U or V do not necessarily have to be regular. There may, for example be bumps or curves or irregular shapes on the contours of the inverted U or V. The shape of an inverted U or V may, alternatively, be expressed as a notch in the front side, wherein the front side has an open bottom end. Once unlocked, after the MOLLE strap or the slider attachment has been inserted, the clip may return to the locked position by use of a spring or spring plate (105), which will tend to push the bottom hook towards the front side to lock. The back side (104) of the clip with a top opening (109) is also shown in FIG. 1. The spring or spring plate (105), in the first embodiment, is located between the back side of the clip (104) and the peg (106).

Figure 2A:
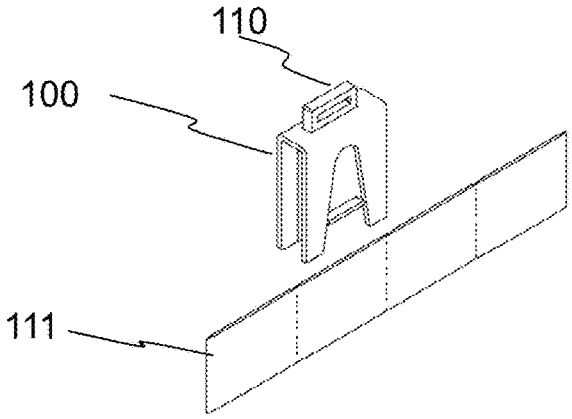
FIG. 2A-2D show an embodiment of the functionality of the presently disclosed MOLLE and slider attachment compatible clip, when a MOLLE strap is inserted in the clip.
Figure 2B:
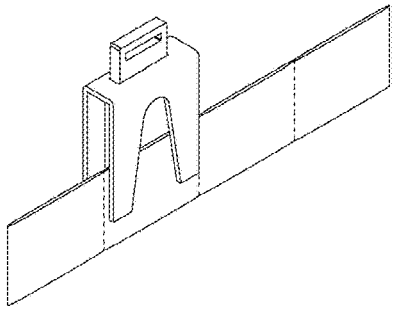
Figure 2C:
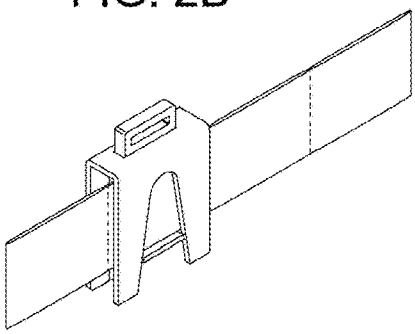
Figure 2D:
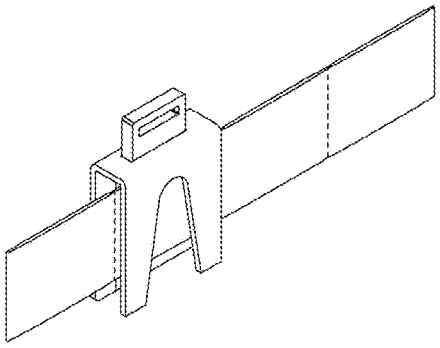

FIGS. 2A-2C show how a the MOLLE strap (111) is inserted in the clip (100). FIG. 2A also shows the pull element (110). In FIG. 2A the clip (100) and the MOLLE strap (111) are separated. As the strap (111) enters the clip (100) the lock control mechanism puts the clip in an open position in FIG. 2B. It can be seen in FIG. 2B that the strap causes the pull element (110) to move upwards. In FIG. 2C, when the strap (111) has fully entered its position in the clip (100), the pull element (110) is moved back downwards and the lock mechanism automatically locks. In FIG. 2D the pull element (110) has been pulled upwards to open the clip (100) again.

Figure 3A:
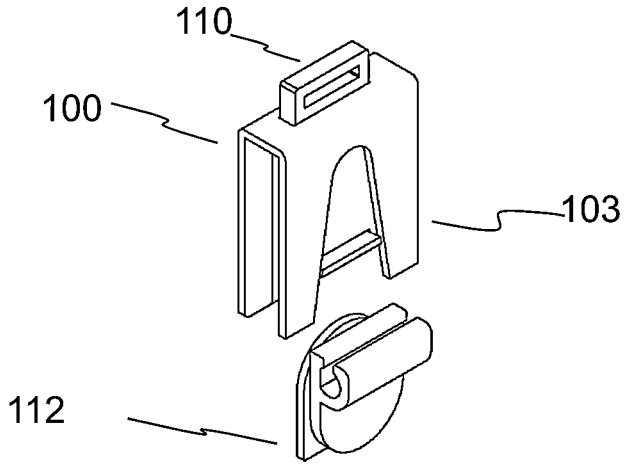
FIG. 3A-3H show an embodiment of the functionality of the presently disclosed MOLLE and slider attachment compatible clip, when a slider attachment element is inserted into the clip.
Figure 3B:
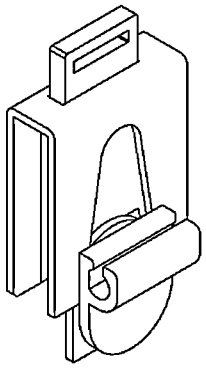
Figure 3C:
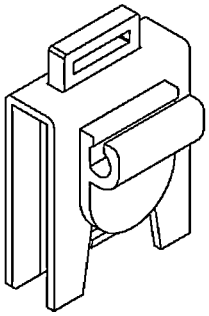
Figure 3D:
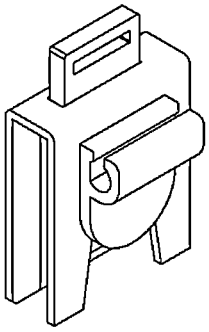
Figure 3E:
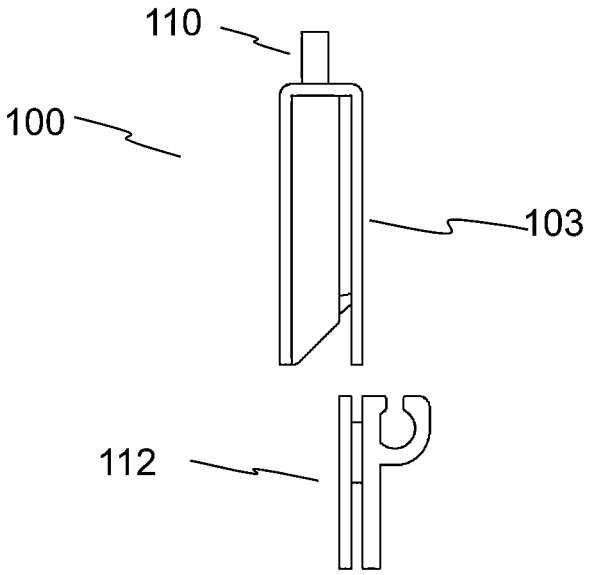
Figure 3F:
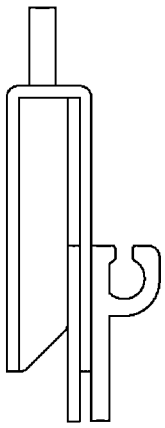
Figure 3G:
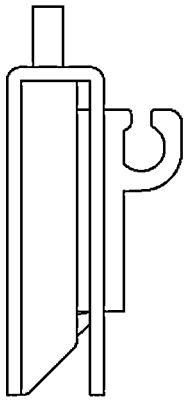
Figure 3H:
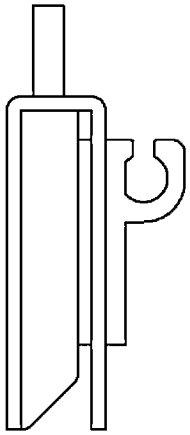

FIGS. 3A-3H show how a slider attachment (112) is inserted into the clip (100). From FIGS. 3A-3H it is clear that the function of the inverted V shaped or inverted U shape of the front side (103) of the clip is to accommodate the slider attachment in the clip. FIGS. 3A-D show a sequence similar to the sequence of FIGS. 2A-D. FIG. 3A: the slider attachment (112) and the clip (100) are completely separated. FIG. 3B: the slider attachment (112) enters the clip (100) and causes the lock mechanism to open and pushes the pull element (110) upwards. FIG. 3C: the slider attachment (112) is a locked position inside the clip (100). FIG. 3D: the pull element (110) has been pulled upwards to open the clip (100) again. FIGS. 3E-H show the same sequence as FIGS. 3A-D from side view.

The bottom hook (102) may have an angle, with respect to the peg (106), that is suitable for locking and unlocking the lock control mechanism and such angle may be between 30 and 80 degrees.

Figure 4A:
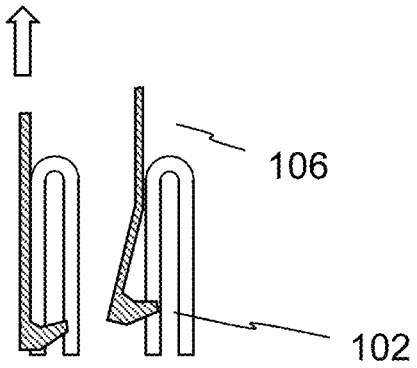
FIG. 4A-4B show, in two embodiments, alternative or complementary principles of working of the MOLLE and slider attachment compatible clip.
Figure 4B:
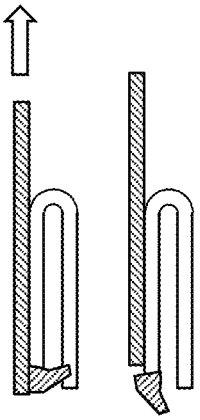

In some embodiments, basic principles of functionality of the lock control mechanism may be based on the peg being flexible and/or on the hook being able to rotate back and/or up. FIG. 4A shows an example of such principle of functionality, wherein the peg (106) is flexible and a pull-up movement of the peg achieves a back-movement of the hook for unlocking of the lock control mechanism. FIG. 4B shows a further example of this principle of functionality wherein the hook is rotatable and a pull-up movement of the peg rotates the hook backwards, opening the lock control mechanism.

Figure 5A:
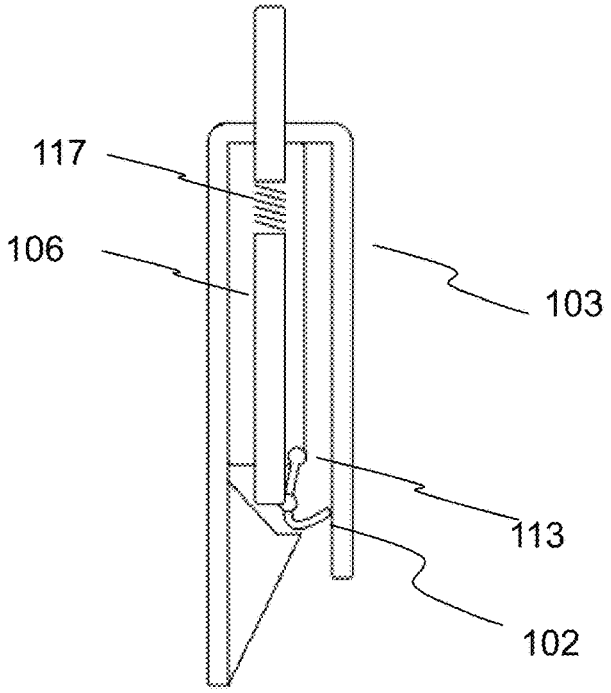
FIG. 5A-5B show a further embodiment of the presently disclosed MOLLE and slider attachment compatible clip.
Figure 5B:
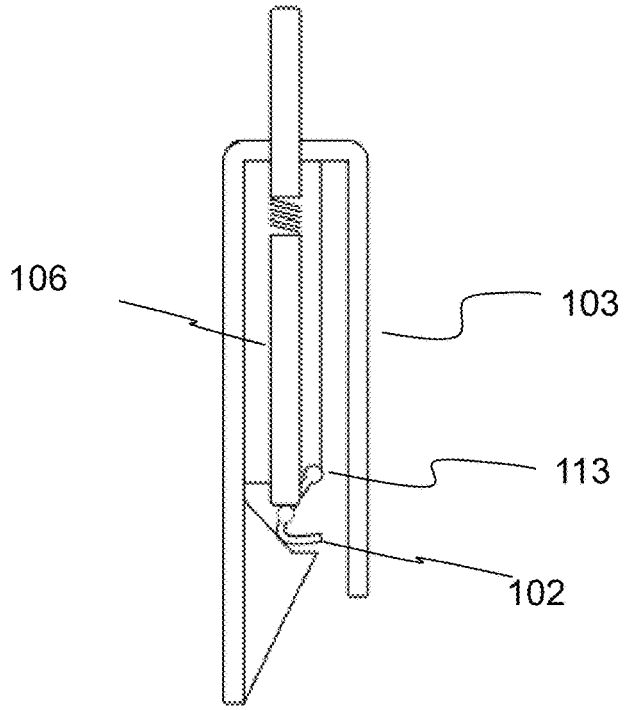

In a further embodiment the bottom hook (102) is rotatable around a pivot point (113). FIG. 5A-5B show the embodiment wherein the bottom hook (102) is rotatable around a pivot point (113). FIG. 5A shows the bottom hook (102) in a locked position against the front side of the clip (103). FIG. 5B shows the bottom hook in an unlocked position. When the peg (106) is being pulled up by the pull element, the bottom hook unlocks by rotating on a pivot point (113) bringing the bottom hook from the locked position shown in FIG. 5A to the unlocked position shown in FIG. 5B. Similarly, by pushing the clip to a MOLLE strap or to a slider attachment element the bottom hook will rotate from position shown in FIG. 5A to position shown in FIG. 5B The peg (106) may comprise a rotatable extension part which may couple with the bottom hook and generate the bottom hook rotation around the pivot (113) point when the peg is being pulled up. Once unlocked, after the MOLLE strap or the slider attachment has been inserted, the clip may return to the locked position by use of a spring (117) which will tend to push the peg downwards and therefore have the bottom hook in a locked position. Unlocking of the peg is realized, either by pushing the hook or by pulling the pull element, overcoming the force of the spring.

The bottom hook (102) may have an angle with respect to the peg (106), that is suitable for locking and unlocking the lock control mechanism and such angle may between 30 and 80 degrees.

Figure 6A:
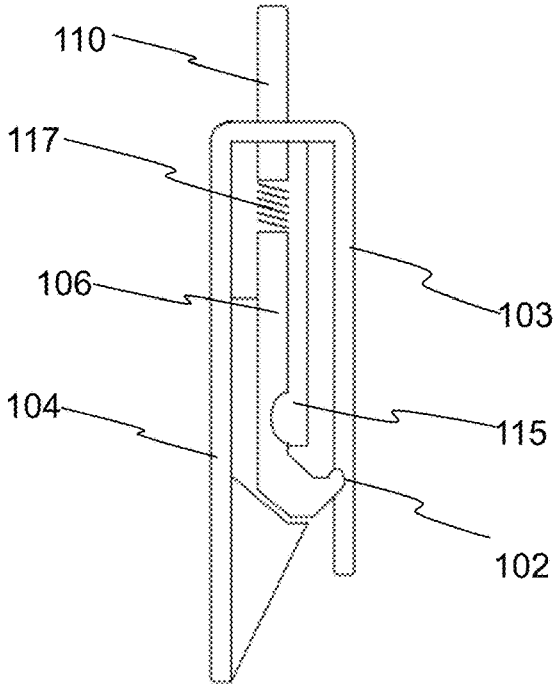
FIG. 6A-6B shows a further embodiment of the presently disclosed MOLLE and slider attachment compatible clip.
Figure 6B:
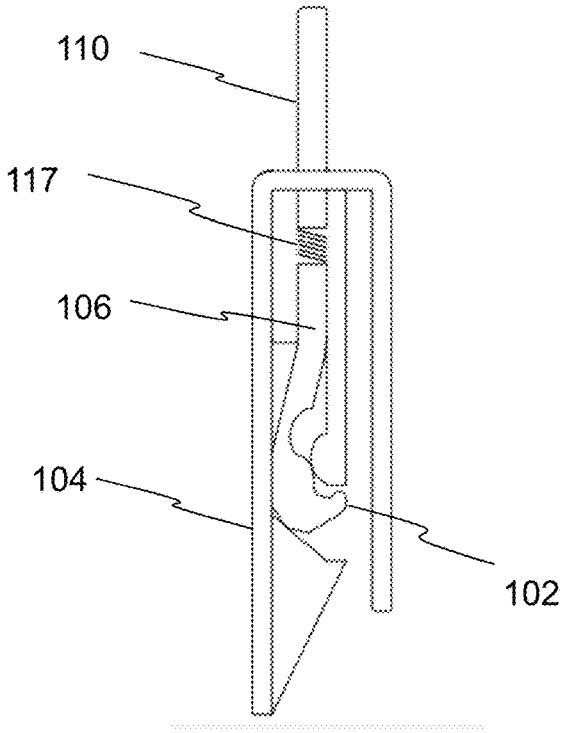

In a further embodiment, shown in FIG. 6A-6B, the MOLLE and slider attachment compatible clip comprises a peg (106) extending between the pull element (110) and the bottom hook (102), wherein the peg and/or the bottom hook are made of a flexible material, the clip further comprising a protrusion (115) configured to deform and/or rotate the peg or bottom hook to unlock the lock control mechanism when the pull element (106) is pulled. The protrusion (115) may be located between the peg (106) and the front side (103) of the clip. It could also be located on the back side (104), which would require a slightly different design of the peg (106). When the pulled element is pulled, the flexible peg (106) deforms around the protrusion (115) generating a back-movement of the bottom hook (102) towards the back side (104) of the clip, unlocking the lock control mechanism. Once unlocked, after the MOLLE strap or the slider attachment has been inserted, the clip may return to the locked position by use of a spring (117) which will tend to push the peg downwards and therefore have the bottom hook in a locked position. Unlocking of the peg is realized, either by pushing the hook or by pulling the pull element, winning the force of the spring.

The bottom hook (102) may have an angle, with respect to the peg (106), that is suitable for locking and unlocking the lock control mechanism and such angle may be between 30 and 80 degrees.

Figure 7A:
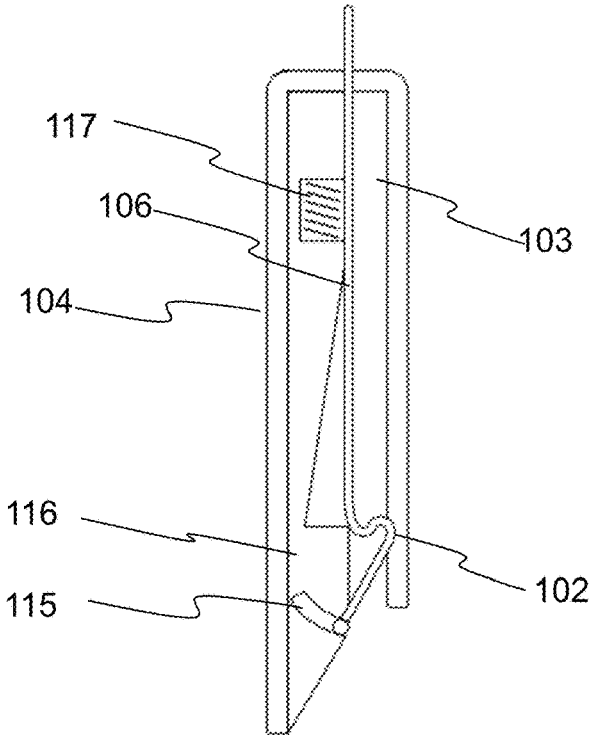
FIG. 7A-7B show a further embodiment of the presently disclosed MOLLE and slider attachment compatible clip.
Figure 7B:
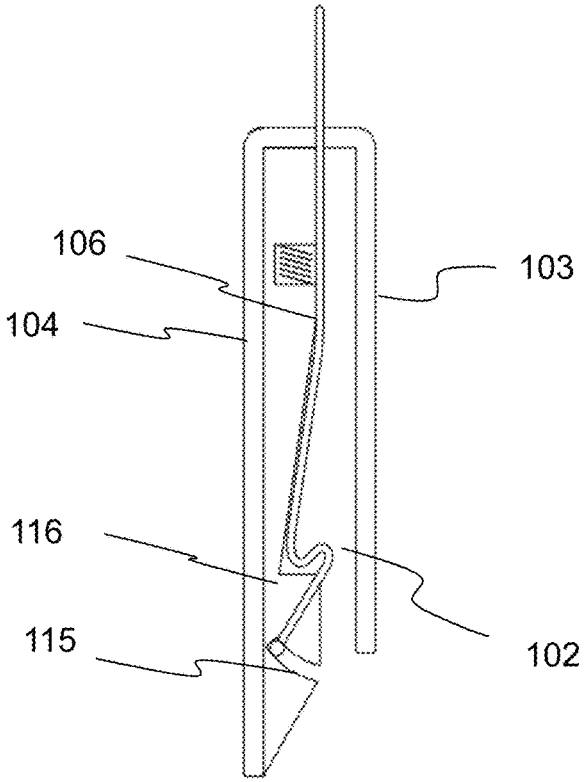

In a further embodiment shown in FIG. 7A-7B, the presently disclosed MOLLE and slider attachment compatible clip comprises a peg (106) extending between the pull element and the bottom hook (102), wherein the peg and the bottom hook are made of a flexible material, the clip further comprising a channel or rail (115) configured to deform and/or rotate the peg or bottom hook to unlock the lock control mechanism when the pull element is pulled.

FIG. 7A-7B show the channel or rail (115) which is formed in a protrusion (116) of the back side (104) of the clip. In a locked position, shown in FIG. 7A, the bottom hook is locked towards the front side (103) of the clip. When pulled up from the pull element, the peg (106) deforms and the channel or rail (115), located in a protrusion (116) of the back side of the clip, guides the bottom hook upwards and backwards towards the back side (104) of the clip, unlocking the clip. Once unlocked, after the MOLLE strap or the slider attachment has been inserted, the clip may return to the locked position by use of a spring (117) which will tend to push the peg downwards and therefore have the bottom hook in a locked position. Unlocking of the peg is realized, either by pushing the hook or by pulling the pull element, overcoming the force of the spring.

Figure 8A:
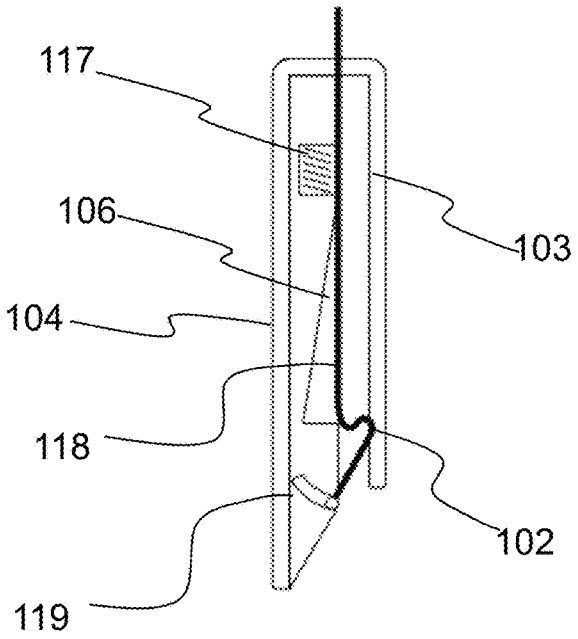
FIG. 8A-8B show a further embodiment of the presently disclosed MOLLE and slider attachment compatible clip.
Figure 8B:
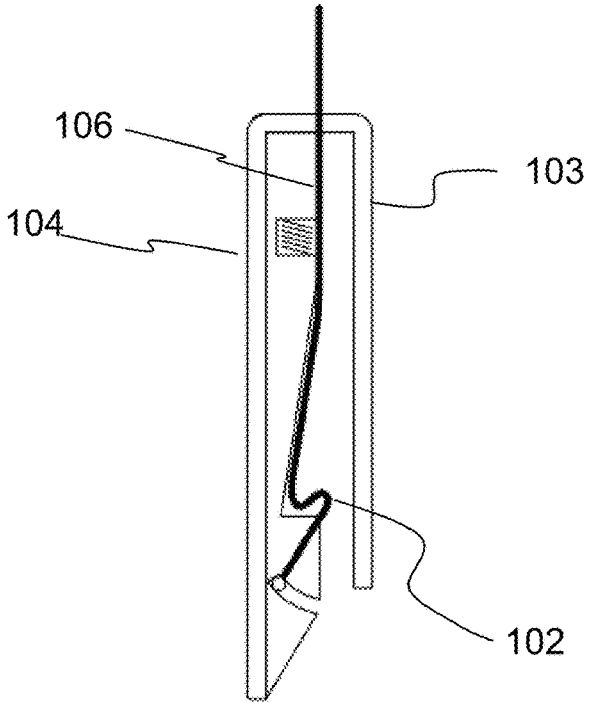

In a further embodiment of the present disclosure, with reference to FIG. 8A-8B, the lock control mechanism may further comprise a bottom extension part (118) connected to the pull element, wherein a movement of the pull element upwards causes the bottom hook to move towards the back side.

The pull element may be connected to an end point of the extension part and the end point is moved backwards and upwards in a channel (119) when the pull element is pulled upwards.

The present disclosure further relates to a MOLLE clip comprising:

a. a main body comprising a back side, a front side, a top side and an open bottom side, wherein the clip is configured to receive a MOLLE strap from the open bottom side of the main body;
b. a locking element arranged in the main body, the locking element comprising a bottom hook for securing the MOLLE strap in a locked position in the main body;
c. a pull element connected to the locking element through a top opening of the top side of the main body; and
d. a lock control mechanism configured to unlock the MOLLE strap from the locked position to an open position by moving the bottom hook towards the back side when the pull element is pulled upwards.

The present disclosure further relates to an assembly comprising:

a. a MOLLE and slider attachment compatible clip as disclosed; and
b. a slider attachment element comprising a locking flange that can be locked and unlocked in the MOLLE and slider attachment compatible clip and a clutch configured to engage and hold a connection element of a garment.

Figure 9A:
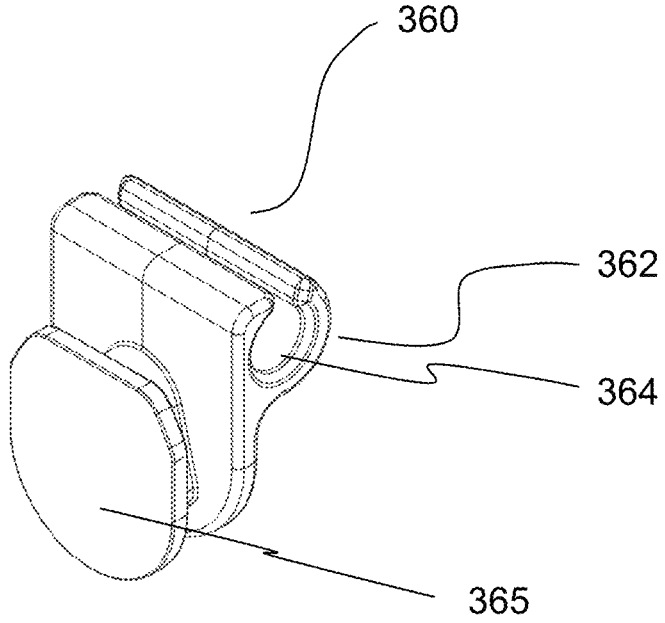
FIG. 9A-9B show an embodiment of the slider attachment element that is configured to be attached to and detached to the presently disclosed MOLLE and slider attachment compatible clip.
Figure 9B:
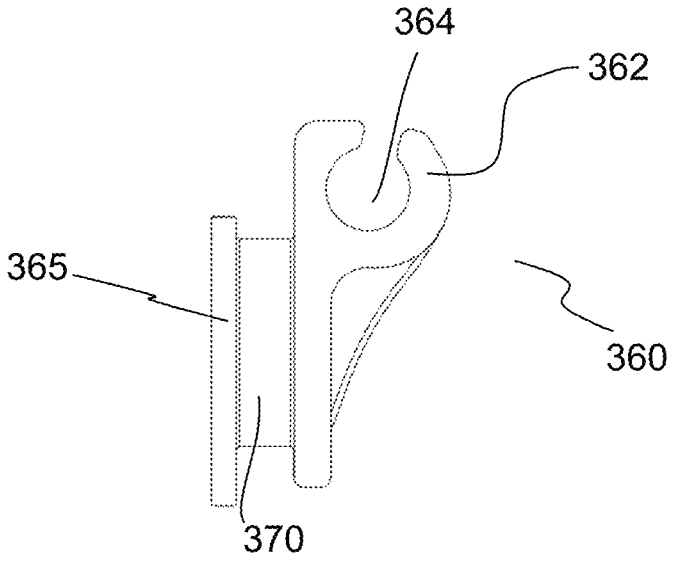

FIG. 9A-B show an embodiment of the present disclosure, wherein the slider attachment element (360) may comprise a clutch (362) having a cavity (364). The clutch (362) may be configured to engage and hold a connection element of an elongated garment portion. Further, the slider attachment element (360) may comprise a locking flange (365). The locking flange (365) may be configured to slide in the clip and provides attachment of the slider attachment element to the clip when the clip is in a locked position. The locking flange may be connected to the clutch by a shaft (370). With reference to FIG. 9A-9B and FIG. 1B, the shaft (370) may have a smaller diameter than the locking flange and a smaller diameter than a cavity (371) of the inverted V-shaped or inverted U-shaped front side (103) of the clip and the shaft (370) may therefore be configured to be sliding up within lateral arms (372) of the inverted V-shaped or inverted U-shaped front side.

REFERENCE

International application PCT/SE2021/050133, "GARMENT WITH ADJUSTABLE ATTACHMENT SYSTEM", is hereby incorporated by reference in its entirety.

Further Details

1. A MOLLE and slider attachment compatible clip comprising:
   a main body comprising a back side, a front side having an open bottom end, the front side configured to receive a shaft of a slider from the open bottom end, a top side and an open bottom side, wherein the clip is configured to receive a MOLLE strap or a slider attachment element from the open bottom side of the main body;
   a locking element arranged in the main body, the locking element comprising a bottom hook for securing the MOLLE strap or a slider attachment element in a locked position in the main body;
   a pull element connected to the locking element through a top opening of the top side of the main body; and
   a lock control mechanism configured to unlock the MOLLE strap or the slider attachment element from the locked position to an open position by moving the bottom hook towards the back side when the pull element is pulled upwards.
2. The MOLLE and slider attachment compatible clip according to item 1, wherein the main body is inverted U-shaped.
3. The MOLLE and slider attachment compatible clip according to any one of the preceding items, wherein the lock control mechanism is configured to move the locking element from the locked position to the open position when the MOLLE strap or slider attachment element is received from the open bottom side of the main body.

4. The MOLLE and slider attachment compatible clip according to item 3, wherein the lock control mechanism is configured to move the locking element from the locked position to the open position by pushing the bottom hook towards the back side when the MOLLE strap or a slider attachment element is received from the open bottom side of the main body.
5. The MOLLE and slider attachment compatible clip according to any one of the preceding items, wherein the lock control mechanism is configured to move the locking element from the open position to the locked position after the MOLLE strap or slider attachment element has been received from the open bottom side of the main body and the MOLLE strap or slider attachment element is positioned inside the MOLLE and slider attachment compatible clip.
6. The MOLLE and slider attachment compatible clip according to item 5, wherein a spring and/or a spring steel plate is configured to apply a lateral force that pushes the bottom hook to the locked position after the MOLLE strap or slider attachment element has been received from the open bottom side of the main body.
7. The MOLLE and slider attachment compatible clip according to any one of the preceding items, wherein the lock control mechanism comprises a spring and/or a spring steel plate configured to apply a lateral force that, in the locked position, secures the bottom hook to the locked position.
8. The MOLLE and slider attachment compatible clip according to item 7, wherein, when the pull element is pulled upwards with a force greater than the force of the spring or the spring steel plate, the MOLLE strap or the slider attachment element is unlocked to an open position from the locked position.
9. The MOLLE and slider attachment compatible clip according to any of the preceding items, configured to unlock and detach the MOLLE strap or the slider attachment element from the clip with one gesture of pulling up the pull element.
10. The MOLLE and slider attachment compatible clip according to any one of the preceding items, wherein the lock control mechanism comprises a peg, wherein said peg is attached to the bottom hook and is rotatable around a pivot point, allowing opening and closing of the hook.
11. The MOLLE and slider attachment compatible clip according to item 10, wherein the pivot point is located at the top side of the clip.
12. The MOLLE and slider attachment compatible clip according to any one of items 10-11, wherein a pulling movement of the pull element connected to the peg causes the peg to rotate around the pivot point, thereby moving the bottom hook towards the back side to detach the bottom hook from the clip.
13. The MOLLE and slider attachment compatible clip according to any one of items 10-12, wherein the spring or the spring steel plate is located between the back side of the clip and the peg and, in a closed position, locks the hook within the inverted V-shaped or inverted U-shaped front side of the clip.
14. The MOLLE and slider attachment compatible clip according to any one of the preceding items, wherein the bottom hook is rotatable around a pivot point.
15. The MOLLE and slider attachment compatible clip according to any one of the preceding items, comprising a peg extending between the pull element and the bottom hook, wherein the peg and/or the bottom hook are made of a flexible material, the clip further comprising a protrusion configured to deform and/or rotate the peg or bottom hook to unlock the lock control mechanism when the pull element is pulled.
16. The MOLLE and slider attachment compatible clip according to item 1, comprising a peg extending between the pull element and the bottom hook, wherein the peg and the bottom hook are made of a flexible material, the clip further comprising a channel or rail configured to deform and/or rotate the peg or bottom hook to unlock the lock control mechanism when the pull element is pulled.
17. The MOLLE and slider attachment compatible clip according to any one of the preceding items, wherein the lock control mechanism further comprises a bottom extension part connected to the pull element, wherein a movement of the pull element upwards causes the bottom hook to move towards the back side.
18. The MOLLE and slider attachment compatible clip according to item 17, wherein the pull element is connected to an end point of the extension part and the end point is moved backwards and upwards in a channel when the pull element is pulled upwards.
19. The MOLLE and slider attachment compatible clip according to any one of the preceding items, wherein the back side of the clip is attached to a first element, such as a tool pouch or tool pocket or tool box or accessory or smaller unit.
20. The MOLLE and slider attachment compatible clip according to any one of the preceding items, wherein the MOLLE strap is attached to a second element, such as a second piece of garment or a second tool box.
21. A MOLLE clip comprising:
    a main body comprising a back side, a front side, a top side and an open bottom side, wherein the clip is configured to receive a MOLLE strap from the open bottom side of the main body;
    a locking element arranged in the main body, the locking element comprising a bottom hook for securing the MOLLE strap in a locked position in the main body;
    a pull element connected to the locking element through a top opening of the top side of the main body; and
    a lock control mechanism configured to unlock the MOLLE strap from the locked position to an open position by moving the bottom hook towards the back side when the pull element is pulled upwards.
22. An assembly comprising:
    a MOLLE and slider attachment compatible clip according to any one of the preceding items; and
    a slider attachment element comprising a locking flange that can be locked and unlocked in the MOLLE and slider attachment compatible clip and a clutch configured to engage and hold a connection element of a garment.

The invention claimed is:

1. A MOLLE clip comprising:

a main body comprising a back side, a front side, a top side and an open bottom side, wherein the clip is configured to receive a MOLLE strap from the open bottom side of the main body;

a locking element arranged in the main body, the locking element comprising a bottom hook for securing the MOLLE strap in a locked position in the main body;

a pull element connected to the locking element through a top opening of the top side of the main body; and a lock control mechanism configured to unlock the MOLLE strap from the locked position to an open position by moving the bottom hook towards the back side when the pull element is pulled upwards.

2. A MOLLE and slider attachment compatible clip comprising:

a main body comprising a back side, an inverted V-shaped or inverted U-shaped front side, a top side and an open bottom side, wherein the clip is configured to receive a MOLLE strap or a slider attachment element from the open bottom side of the main body;

a locking element arranged in the main body, the locking element comprising a bottom hook for securing the MOLLE strap or a slider attachment element in a locked position in the main body;

a pull element connected to the locking element through a top opening of the top side of the main body; and a lock control mechanism configured to unlock the MOLLE strap or the slider attachment element from the locked position to an open position by moving the bottom hook towards the back side when the pull element is pulled upwards.

3. The MOLLE and slider attachment compatible clip according to claim 2, wherein the lock control mechanism is configured to move the locking element from the locked position to the open position when the MOLLE strap or slider attachment element is received from the open bottom side of the main body.

4. The MOLLE and slider attachment compatible clip according to claim 3, wherein the lock control mechanism is configured to move the locking element from the locked position to the open position by pushing the bottom hook towards the back side when the MOLLE strap or a slider attachment element is received from the open bottom side of the main body.

5. The MOLLE and slider attachment compatible clip according to claim 2, wherein the lock control mechanism is configured to move the locking element from the open position to the locked position after the MOLLE strap or slider attachment element has been received from the open bottom side of the main body and the MOLLE strap or slider attachment element is positioned inside the MOLLE and slider attachment compatible clip.

6. The MOLLE and slider attachment compatible clip according to claim 5, wherein a spring and/or a spring steel plate is configured to apply a lateral force that pushes the bottom hook to the locked position after the MOLLE strap or slider attachment element has been received from the open bottom side of the main body.

7. The MOLLE and slider attachment compatible clip according to claim 2, wherein the lock control mechanism comprises a spring and/or a spring steel plate configured to apply a lateral force that, in the locked position, secures the bottom hook to the locked position.

8. The MOLLE and slider attachment compatible clip according to claim 2, configured to unlock and detach the MOLLE strap or the slider attachment element from the clip with one gesture of pulling up the pull element.

9. The MOLLE and slider attachment compatible clip according to claim 2, wherein the lock control mechanism comprises a peg, wherein said peg is attached to the bottom hook and is rotatable around a pivot point, allowing opening and closing of the hook.

10. The MOLLE and slider attachment compatible clip according to claim 9, wherein a pulling movement of the pull element connected to the peg causes the peg to rotate around the pivot point, thereby moving the bottom hook towards the back side to detach the bottom hook from the clip.

11. The MOLLE and slider attachment compatible clip according to claim 2, comprising a peg extending between the pull element and the bottom hook, wherein the peg and/or the bottom hook are made of a flexible material, the clip further comprising a protrusion configured to deform and/or rotate the peg or bottom hook to unlock the lock control mechanism when the pull element is pulled.

12. The MOLLE and slider attachment compatible clip according to claim 2, comprising a peg extending between the pull element and the bottom hook, wherein the peg and the bottom hook are made of a flexible material, the clip further comprising a channel or rail configured to deform and/or rotate the peg or bottom hook to unlock the lock control mechanism when the pull element is pulled.

13. The MOLLE and slider attachment compatible clip according to claim 2, wherein the lock control mechanism further comprises a bottom extension part connected to the pull element, wherein a movement of the pull element upwards causes the bottom hook to move towards the back side.

14. The MOLLE and slider attachment compatible clip according to claim 13, wherein the pull element is connected to an end point of the extension part and the end point is moved backwards and upwards in a channel when the pull element is pulled upwards.

15. An assembly comprising:

a MOLLE and slider attachment compatible clip according to claim 2; and a slider attachment element comprising a locking flange that can be locked and unlocked in the MOLLE and slider attachment compatible clip and a clutch configured to engage and hold a connection element of a garment.

* * * * *